US006204465B1

(12) United States Patent
Gula et al.

(10) Patent No.: US 6,204,465 B1
(45) Date of Patent: Mar. 20, 2001

(54) CIRCUIT BREAKER WITH ARC GAS ENGAGING PADDLES ON A TRIP BAR AND/OR CROSSBAR

(75) Inventors: Lance Gula, Clinton; Richard Paul Malingowski, Finleyville; Kathryn Miles Palmer, Sewickley; William Ellsworth Beatty, Jr., Beaver, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/542,076

(22) Filed: Apr. 3, 2000

(51) Int. Cl.[7] ..... H01H 33/34
(52) U.S. Cl. ..... 218/154; 335/172; 218/157
(58) Field of Search ..... 335/23–25, 167–174, 335/201; 218/154

(56) References Cited

U.S. PATENT DOCUMENTS 4,679,016 * 7/1987 Ciarcia et al. ..... 335/132
5,910,757 * 6/1999 Broghammer et al. ..... 335/9
5,910,760 6/1999 Malingowski et al. .
5,994,988 * 11/1999 Ferree et al. ..... 335/190

FOREIGN PATENT DOCUMENTS 2-207436 * 2/1990 (JP) .

* cited by examiner

*Primary Examiner*—Lincoln Donovan
(74) *Attorney, Agent, or Firm*—Martin J. Moran

(57) ABSTRACT

A molded case circuit breaker has paddles on the trip bar to utilize the arc gases generated during interruption to speed operation of the latchable operating mechanism and to protect the trip mechanism from debris in the arc gases. Alternatively, or in addition, lateral projections can be provided on the crossbar for similar purposes.

8 Claims, 8 Drawing Sheets

CIRCUIT BREAKER WITH ARC GAS ENGAGING PADDLES ON A TRIP BAR AND/ OR CROSSBAR

BACKGROUND OF THE INVENTION

1. Field of the Invention

This invention relates to circuit breakers having a trip bar which unlatches a latchable operating mechanism to open separable contacts in the circuit breaker. More particularly, it relates to arrangements for using arc gases generated during interruption to speed opening of the circuit breaker and/or for protecting moving parts from debris in the arc gases.

2. Background of the Invention

A common type of multi-phase circuit breaker has a molded case with side-by-side compartments for each of the poles. Each pole has separable contacts including a fixed contact and a moveable contact. The moveable contact is carried by a moveable contact assembly. The moveable contact assemblies of all of the poles are joined by crossbar for simultaneous opening and closing of the contacts in all of the poles. A single operating mechanism is coupled to the crossbar for manual opening and closing of the contacts through manipulation of a circuit breaker handle. The contacts can also be tripped open automatically by a trip unit which monitors the current in each of the poles. The trip unit includes a rotatably mounted trip bar which latches the operating mechanism. Upon detection of an overcurrent condition, a trip unit rotates the trip bar to unlatch the operating mechanism which then opens the contacts and all of the poles through rotation of the crossbar.

A certain amount of time is required for the trip unit to respond to the overcurrent condition and for the operating mechanism to initiate opening of the contacts after being unlatched by the trip bar. In order to speed up tripping in response to short circuits or other very high overcurrents, it is common to provide the moveable contact assemblies with a blow-open feature. Typically, the moving contact assembly includes a base member which is coupled to or formed integrally with the crossbar and therefore rotated by the crossbar. The moveable contact is affixed to the free end of a contact arm which is pivotally connected to the base member by a blow-open coupling. With the contacts closed, the contact arm is arranged in close proximity to a portion of the line conductor to which the fixed contact is attached and in which the current flows in a direction opposite to the direction through the contact arm. The magnetic fields produced by the oppositely flowing currents generate a very large repulsion force which rotates the contact arm relative to the base member and therefore blows the contacts open. The trip unit and operating mechanism subsequently respond and recouple the contact arm to the base member. This blow-open feature has been very effective in responding to very high overcurrents. However, there is room for improvement.

The arcs generated during interruption of a short circuit generate gases which typically contain debris in the form of vaporized contact material. This debris can become deposited on other components of the circuit breaker and have a detrimental effect on the operation of mechanical parts. In particular, debris deposited from arc gases on an electromechanical trip device can increase friction and result in poor performance. Hence, there is also room for improvement in the control of arc gases in circuit breakers.

SUMMARY OF THE INVENTION

This invention is directed to an improved circuit breaker which better manages the arc gases generated during interruption, and particularly during interruption of large overcurrents such as those associated with short circuits. As one aspect of the invention, the arc gases generated during blow-open of the contacts are used to speed up response of the trip unit to the overcurrent. More particularly, the arc gases are used to speed rotation of the trip bar which unlatches the operating mechanism. Panels extending laterally from the rotatably mounted trip bar are impacted by the arc gases which impart a rotation of the trip bar in a trip direction. These paddles projecting from the trip bar can simultaneously protect the trip unit and particularly an electromagnetic trip mechanism from debris in the arc gases.

Lateral projections can also be provided on the crossbar which is situated between the separable contacts and the trip bar or other trip mechanism of the trip unit. These projections are situated to produce moments on the crossbar which aid in opening of the separable contacts. If maximum protection of the trip unit from debris in the arc gases is desired, the projections on the crossbar can be sized accordingly and the effect of the arc gases on the trip bar will be reduced.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
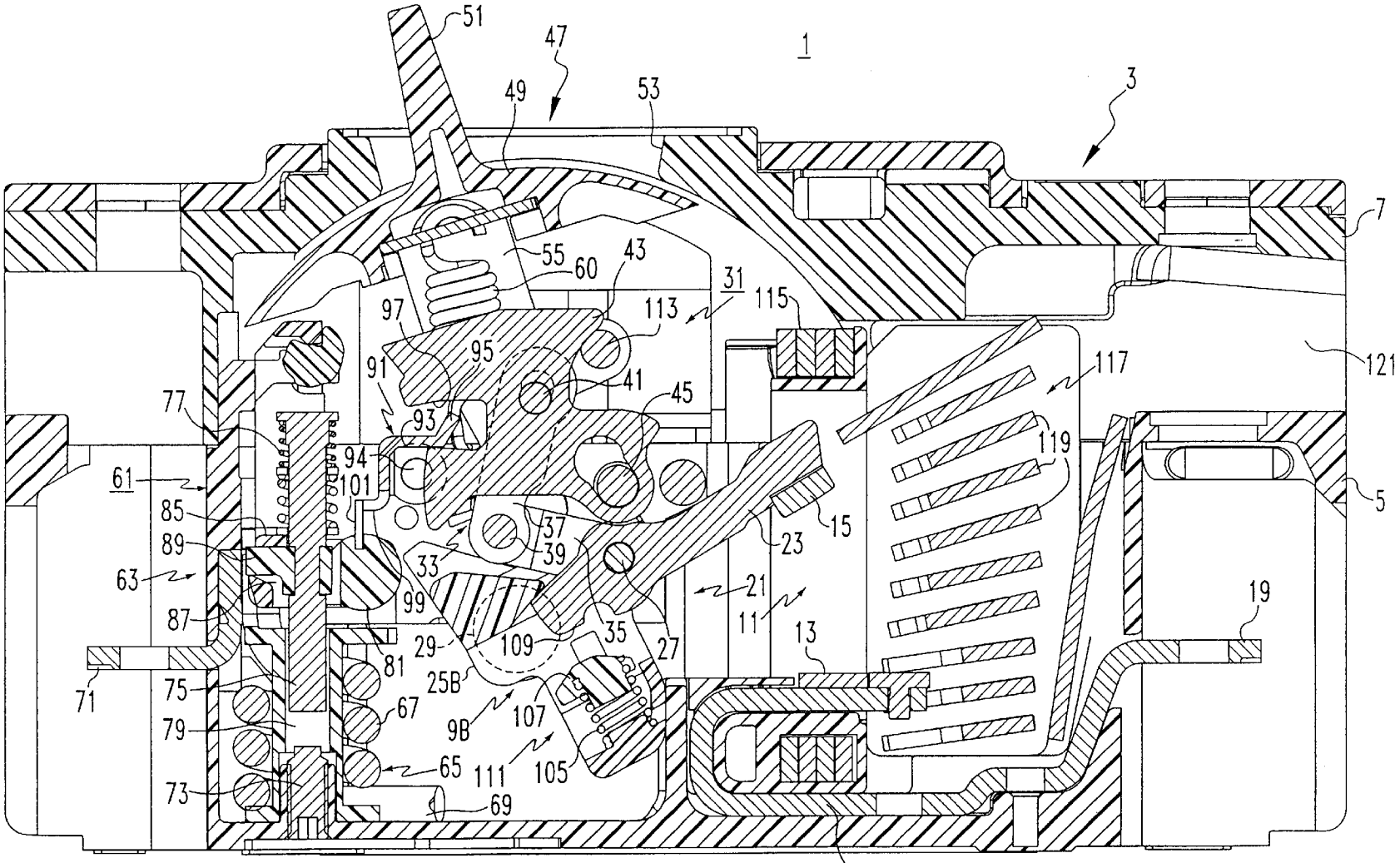
FIG. 1 is a vertical section through the center pole of a circuit breaker incorporating the invention shown in the off condition.

Referring to FIGS. 1–5, the circuit breaker 1 is a molded case breaker having a molded housing 3 composed of a base 5 and a cover 7. The circuit breaker 1 has three poles 9A–9C housed in compartments side-by-side. While the invention is described as applied to a three-pole circuit breaker, it will become evident that the principles involved are applicable to circuit breakers with other numbers of poles.

Each pole 9 includes separable contacts 11 formed by a fixed contact 13 and a moveable contact 15. The fixed contact 13 is mounted on a line conductor 17 which terminates in a line terminal 19 for connection to an electrical distribution system (not shown).

Figure 6:
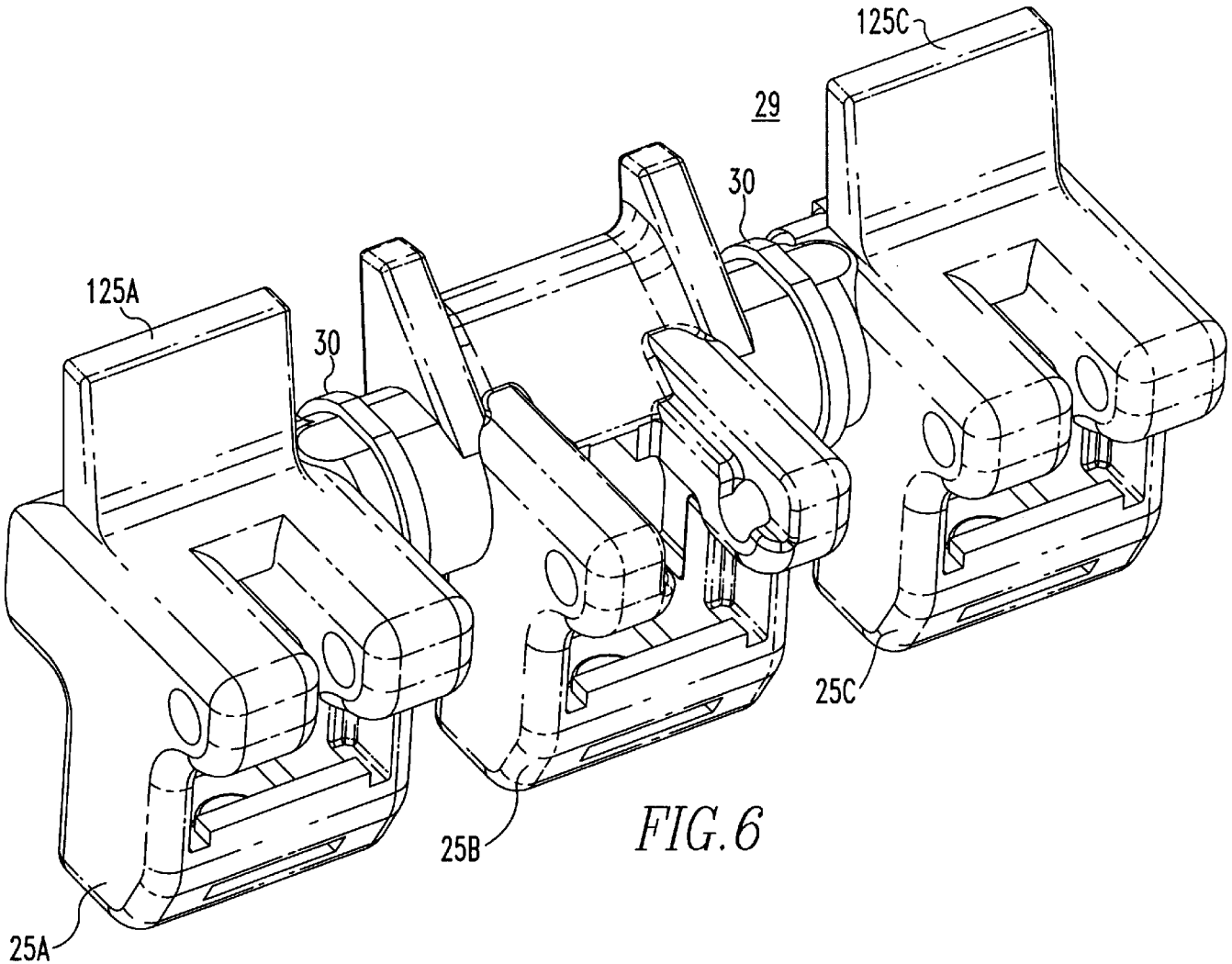
FIG. 6 is an isometric view of a crossbar which forms part of the circuit breaker.

A moveable contact assembly 21 in each pole includes a contact arm 23 which carries the moveable contact at one end. The opposite end of the moveable contact arm 23 is pivotally mounted on a contact arm support 25A–25C by a pivot pin 27. As best seen in FIG. 6, the contact arm supports 25 for each of the poles are joined together to form a single unit by an integrally molded crossbar 29. The crossbar 29 is mounted for rotation by integral bearings 30 journaled in the molded base 5.

A single latchable operating mechanism 31 opens and closes the separable contacts in all of the compartments simultaneously through connection to the contact arm support 25B in the center pole. This latchable operating mechanism includes a toggle linkage 33 having a lower toggle link 35 connected to the contact arm support 25B by the same pivot pin 27 connecting the moveable contact arm 23. The toggle linkage 33 also includes an upper toggle link 37 pivotally connected to the lower toggle link by a knee pin 39. The upper end of the upper toggle link 37 is pivotally connected by a pivot pin 43 to a cradle 41 which in turn is pivotally mounted on a fixed pin 45.

Figure 8:
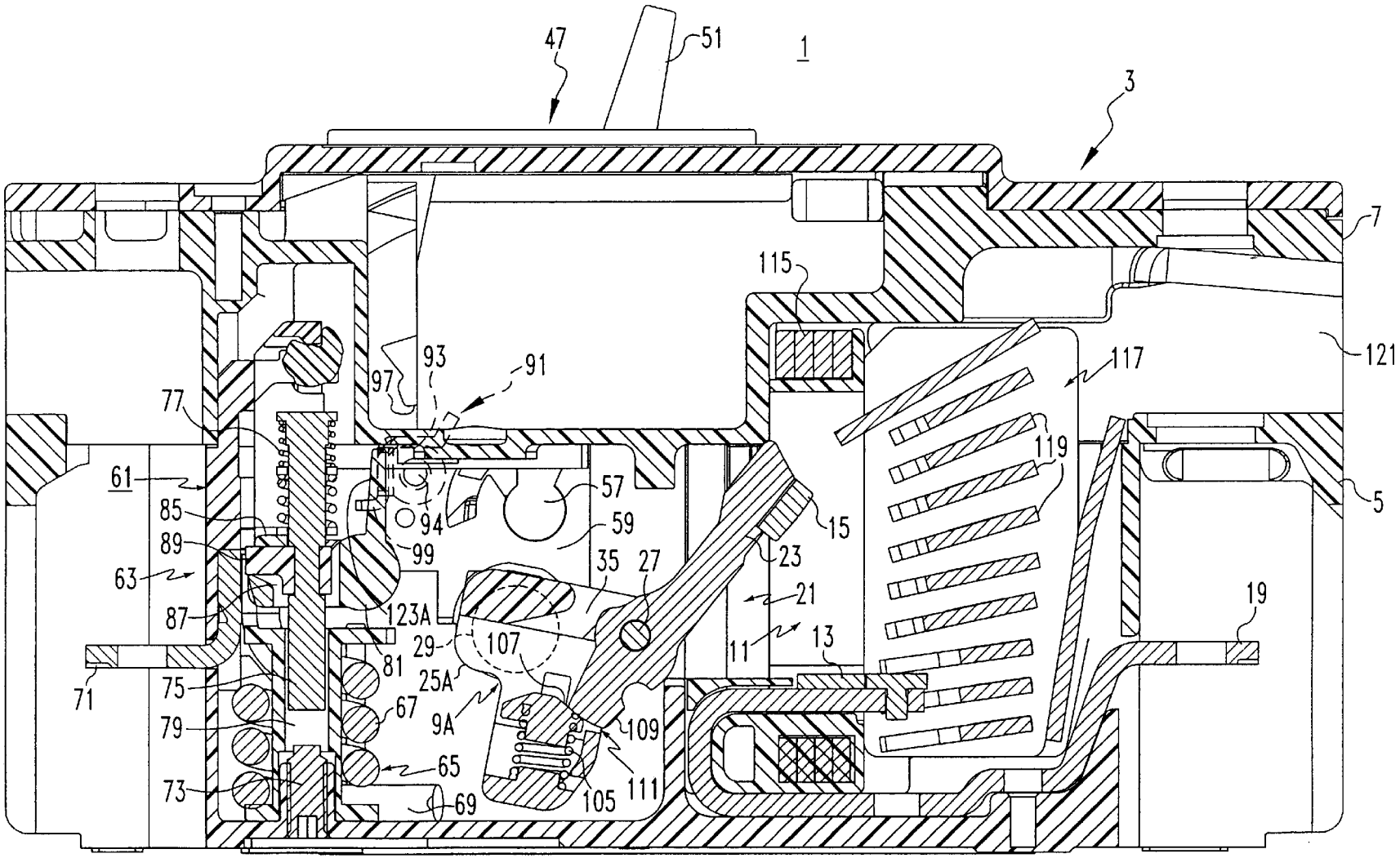
FIG. 8 is a vertical section through one of the outer poles shown in the blown open condition.

A handle assembly includes a molded operating member 49 with an integral handle 51 which extends through an opening 53 in the cover 7. The handle assembly 47 further includes a yoke 55 which as can be seen in FIG. 8 is pivotally mounted for rotation through an arc in a recess 57 and a side plate 59. A pair of helical compression springs 60 (only one shown) are connected at one end to the knee pin 39 and at the other end to the bight of the yoke 55.

Figure 7:
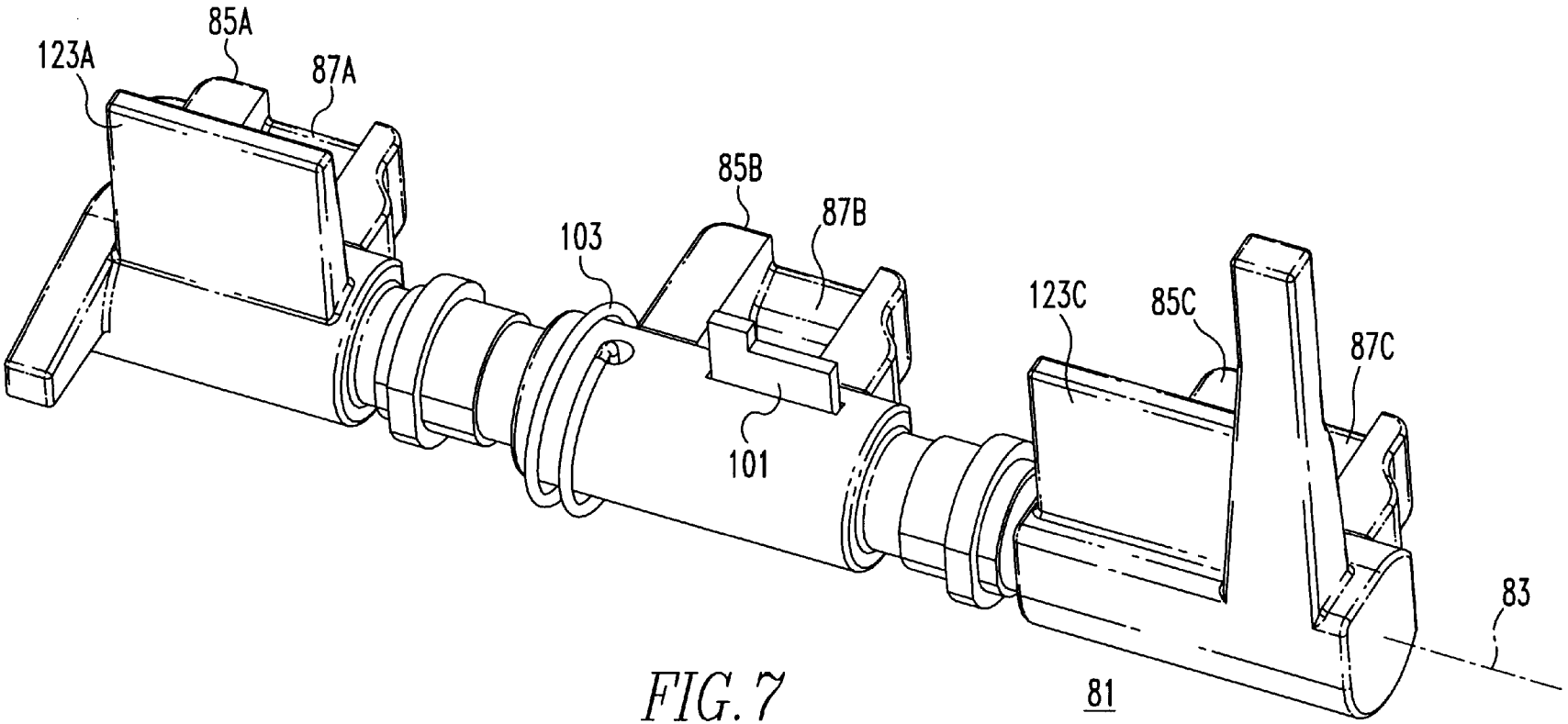
FIG. 7 is an isometric view of a trip bar which forms part of the circuit breaker.

The circuit breaker 1 also has a trip unit 61 which includes a trip mechanism 63A–63C for each pole. Each trip mechanism 63 includes a trip solenoid 65 having a coil 67 which is connected at one end to the associated contact arm 23 through a flexible shunt 69 (only partially shown for clarity), and at the other end to a load terminal 71. Thus, the main current path of each pole through the circuit breaker includes the line terminal 19, the line conductor 17, the fixed contact 13, the moveable contact 15, the moveable contact arm 23, the flexible shunt 67, the trip solenoid 65, and the load terminal 69. Each trip solenoid 65 includes a pole piece 73 and a moveable core 75 which is spaced from the pole piece 73 by a spring arrangement 77 to form a gap 79. The trip unit 61 also includes a common trip bar 81 which is best seen in FIG. 7. This trip bar extends across all of the trip mechanisms 63 and is mounted for rotation about a longitudinal axis 83. Projecting from the trip bar 81 adjacent each of the trip mechanisms is a saddle 85A–85C which has an opening 87A–87C through which the moveable core 75 of the associated trip mechanism 63 extends. The moveable cores have a trip lever 89 extending transversely therefrom above the associated saddle 85.

The trip unit 61 also includes a latch assembly 91 for latching the latchable operating mechanism 31. This latch assembly 91 includes a pivotally mounted intermediate latch member 93 having a latch finger 95 at one end which engages a latch notch 97 on the cradle. A lower arm 99 on the intermediate latch member 93 engages a latch interface 101 projecting from the trip bar 81. The trip bar is biased clockwise as viewed in FIGS. 1–5 by a torsion spring 103 (see FIG. 7).

FIG. 1 shows the circuit breaker in the off condition with the moveable contact arm 23 of each of the poles rotated counterclockwise to open the separable contacts. The springs 60 pull up in the knee pin 39 so that the upper toggle link 37 tends to rotate the cradle 43 clockwise about the pivot pin 45. However, this rotation is opposed by the latch assembly 91.

Figure 2:
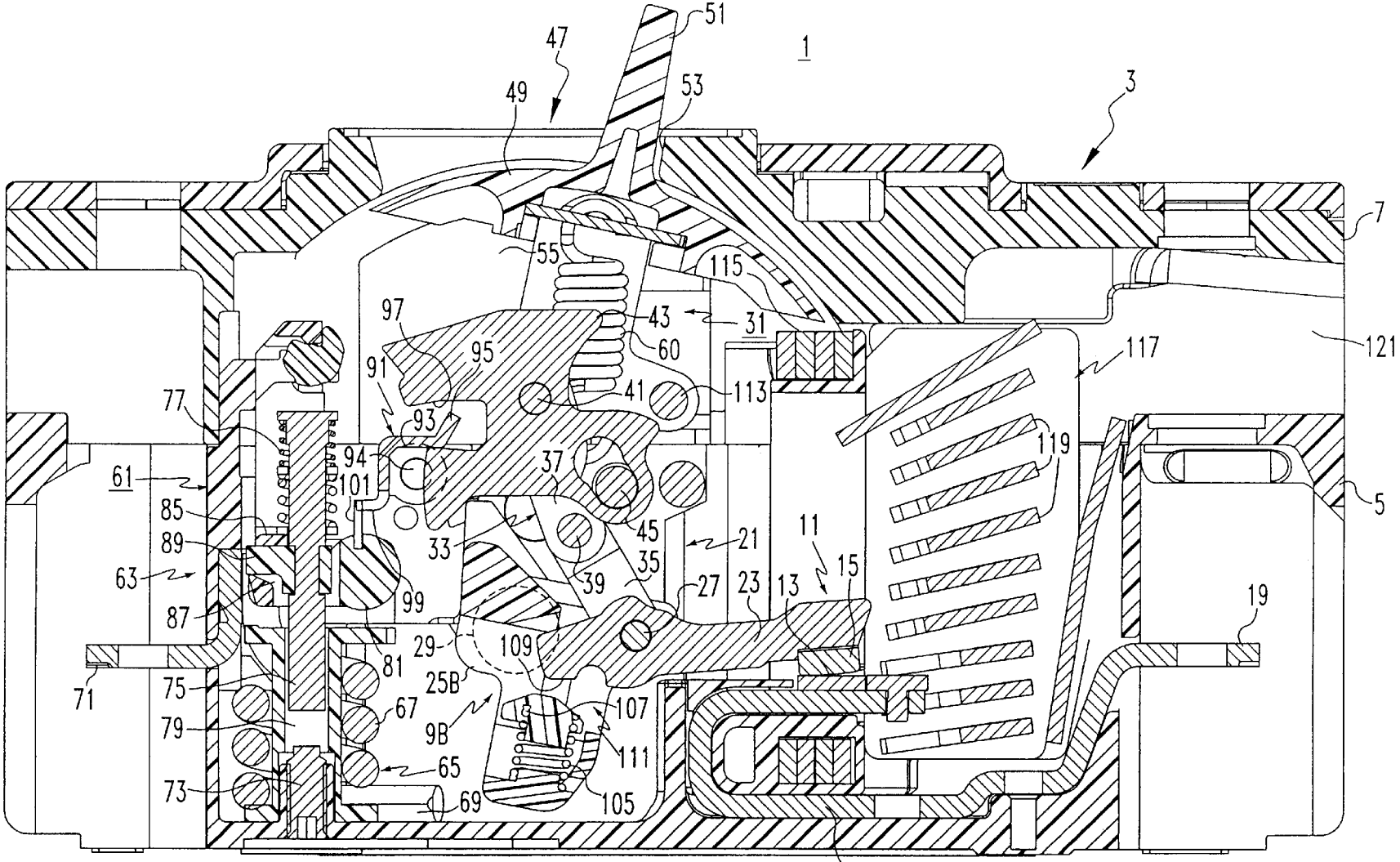
FIG. 2 is a vertical section similar to FIG. 1 but showing the circuit breaker in the on condition.
Figure 3:
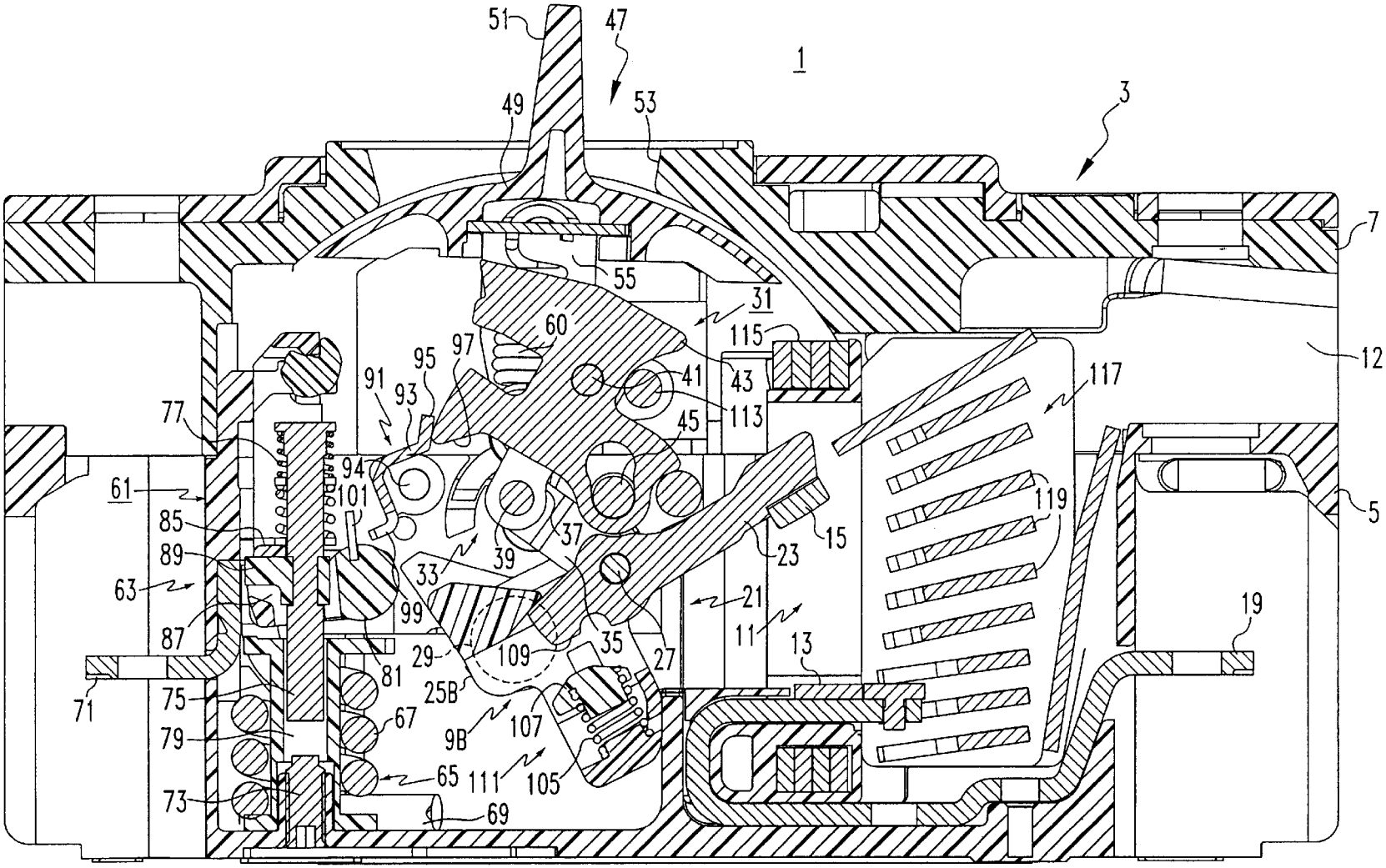
FIG. 3 is a vertical section similar to FIG. 1 but showing the circuit breaker in the tripped condition.
Figure 4:
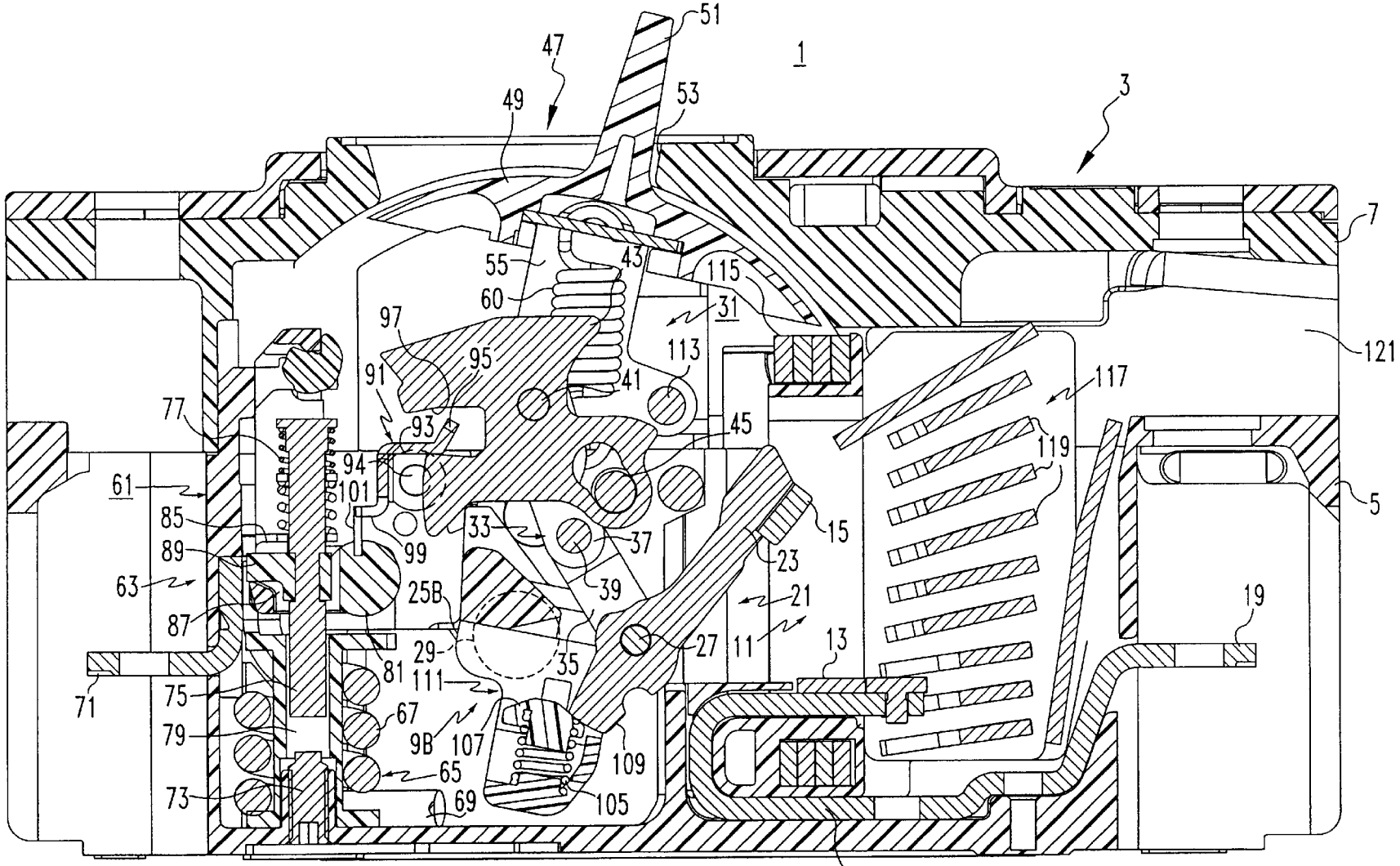
FIG. 4 is a vertical section similar to FIG. 1 showing the circuit breaker in the blown open condition.
Figure 5:
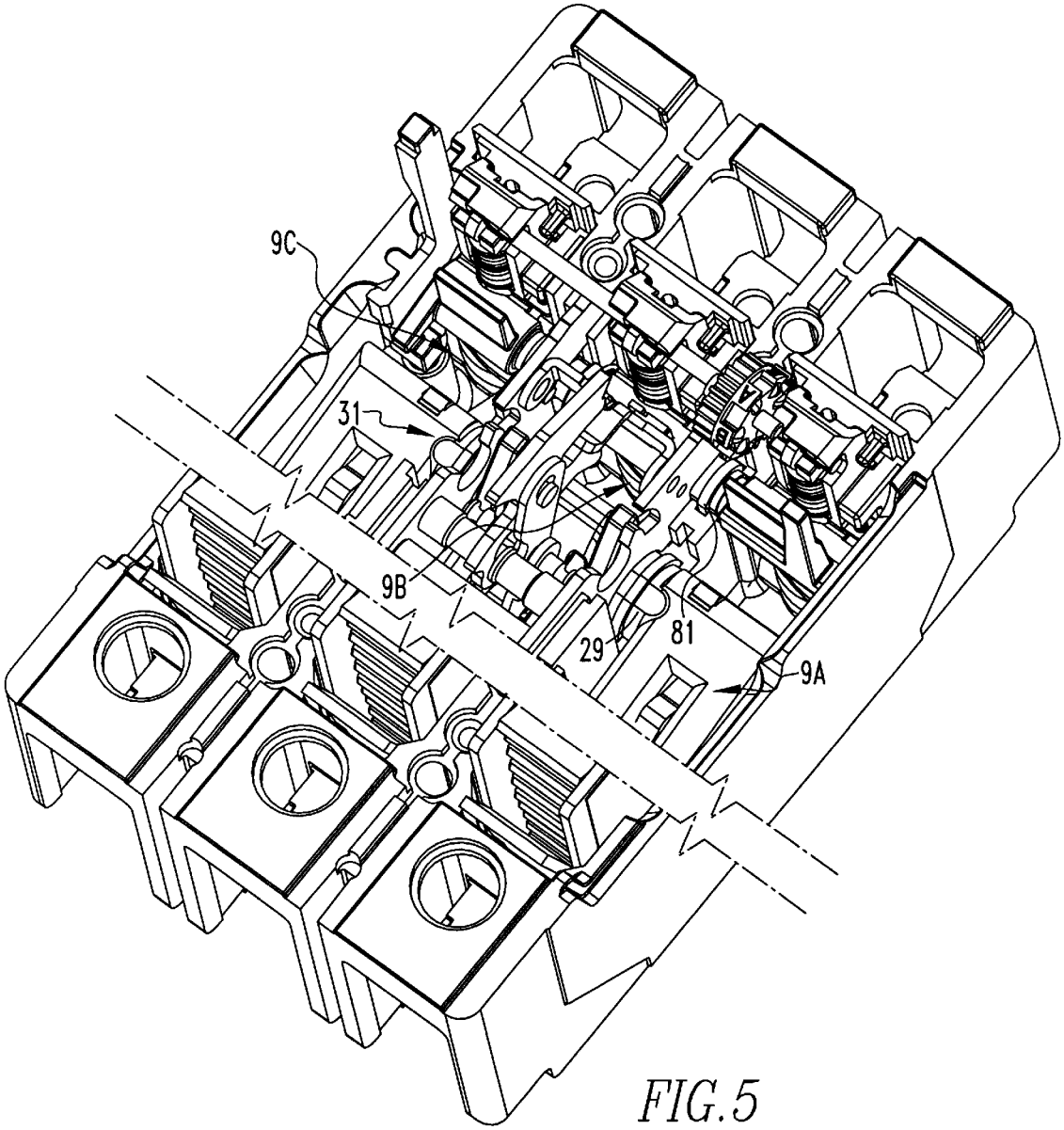
FIG. 5 is an isometric view of a portion of the circuit breaker shown with the cover removed.

The circuit breaker is moved to the closed condition by rotation of the handle 51 clockwise to the position shown in FIG. 2. When the line of force of the springs 60 pass to the right of the pivot pin 41, the toggle linkage 33 is erected and rotates the contact arm 23 clockwise to close the separable contacts 11. The latch assembly 91 remains engaged during this operation to prevent the cradle 43 from rotating. In order to apply contact pressure and accommodate for wear on the contacts 13 and 15, a contact spring 105 is mounted in the moveable contact arm support 25 and bears against a cam follower 107 which engages a cam surface 109 on the end of the contact arm 23 opposite the end carrying the moveable contact.

The circuit breaker 1 can be manually opened by returning the handle 51 to the position shown in FIG. 1. When the line of force of the springs 60 pass to the left of the pivot pin 41, the toggle linkage 33 collapses to raise the contact arm 23 of the center pole which results in opening of the separable contacts 15 and all of the poles through the crossbar 29.

Protection against overcurrents is provided by the trip unit 61. When the current through the trip solenoid 65 becomes sufficiently high, such as would be associated with a short circuit, the magnetic flux generated by this current is sufficient to pull the moveable core 75 down against the bias of the spring assembly 77 to close the gap 79. As the moveable core 75 is pulled downward, the trip lever 89 engages the associated saddle 89 on the trip bar 81 thereby rotating the trip bar counterclockwise to the tripped position shown in FIG. 3. This rotation of the trip bar 81 causes the latch interface 101 to disengage from the intermediate latch lower arm 99 to unlatch the latchable operating mechanism as the latch finger 95 rotates out of engagement with the latch notch 97 on the cradle. With the cradle 43 unrestrained it rotates clockwise about the pivot pin 45. When the pin 41 carried by the cradle passes to the right of the line of force of the springs 60, the toggle linkage 33 collapses to open the contact arms 23. Notice in FIG. 3 that with the circuit breaker 1 in the tripped condition, the handle 51 is in an intermediate position to provide a visual indication of the tripped condition.

As mentioned, the circuit breaker 1 is provided with a blow open feature which allows the circuit breaker to respond more quickly to a short circuit and therefore interrupt the current at a lower peak value. This feature is provided by a blow open coupling 111 formed by the contact spring 105, cam follower 107 and cam surface 109 on the contact arm 23 in cooperation with the routing of the line conductor 17. As will be noticed, the line conductor extends to the left from the fixed contact parallel to the contact arm when the contacts are closed. Thus, current flowing through the circuit breaker when the contacts 15 are closed flows in one direction in the contact arm and in the opposite direction in the closely spaced parallel portion of the line conductor. These opposed currents generate magnetic repulsion forces which in the case of short circuit currents, are strong enough to rotate the contact arm on the pin 27 against the bias of the contact spring to the blow open position shown in FIG. 4. While the current needed to blow the contacts open is also sufficient to actuate the trip mechanism, the reaction time is longer. When the trip mechanism does unlatch the latchable operating mechanism 31, the trip sequence described above occurs and the contact support member rotates counterclockwise to reestablish the relative position of the contact arm.

The latchable operating mechanism 31 is relatched following a trip by rotating the handle 51 counterclockwise beyond the off position to a reset position in which the reset pin 113 on the yoke engages the cradle 43 and carries it counterclockwise until the intermediate latch reengages the latch notch 97 on the cradle.

When the circuit breaker 1 interrupts a very high current such as a short circuit current, an arc is struck between the fixed contact 13 and moveable contact 15 as they separate. This very large current induces an eddy current in an arc motor 115 surrounding each contact arm. This eddy current generates a magnetic field and helps to drive the arc into an arc chute 117 beyond the end of the contact arm 23. The arc chute 117 is made up of a number of spaced plates 119 which divide the arc voltage and tend to cool the arc to distinguish it. The majority of the arc gases then pass out through a vent 121. However, the volume and pressure of the gases generated can also blow back along the contact arm, through the crossbar and toward the trip mechanisms 63. These arc gases can contain debris in the form of vaporized contact material which can be deposited upon the surfaces of the trip mechanism thereby increasing friction forces and impeding its operation. We have also found that these arc gases have a good deal of energy which can be employed to speed up tripping. Hence, we have provided paddles 123 on the trip bar 81 extending transversely from the longitudinal axis 83. As can be seen in FIG. 7 such paddles 123A and 123C are provided on the portions of the trip bar 81 extending through the outer poles 9A and 9C. The latchable operating mechanism 31 is provided in the center pole thereby blocking to some extent the rearward movement of gases in this pole. In addition, the latch interface 101 is provided on this section of the trip bar. The paddles 123A and 123C extend upward on the trip bar 81 generally transversely to the flow gases so that they are engaged by the gases and rotate the trip bar counterclockwise in the trip direction. Thus, they initiate tripping of the circuit breaker. This occurs simultaneously with rotation of the trip bar by the solenoid. At the same time, these paddles 123 deflect arc gases in the associated poles upward and away from the trip mechanisms 63 (see FIG. 8), and particularly the spring assemblies 77 where deposit of debris could impede the operation of the trip mechanism.

As an alternative to, or in addition to, the paddles 123 on the trip bar, lateral projections 125 can be provided on the crossbar 29 as shown in FIGS. 6 and 8. These lateral projections extend transversely to the flow of gases and in a direction to aid counterclockwise rotation of the crossbar which opens the separable contacts 15. At the same time, these lateral projections 125 block, at least to some extent depending upon their size, the rearward flow of gases toward the trip mechanism and even the paddles 123 on the trip bar. Again, the lateral projection 125A and 125C are only provided on the crossbar 29 in the outer poles 9A and 9C.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

separable contacts including a fixed contact and a moveable contact;

a moveable contact assembly carrying said moveable contact;

a latchable operating mechanism coupled to said moveable contact assembly for opening said separable contacts when unlatched; and a trip unit including a rotatable trip bar which rotates to unlatch said latchable operating mechanism and open said separable contacts in response to an overcurrent through said circuit breaker, said moveable contact assembly incorporating a blow open coupling which allows said separable contacts to blow open in response to a short circuit current before said latchable operating mechanism unlatches, and said trip bar having at least one paddle positioned to be engaged by arc gases generated when said separable contacts blow open to rotate the trip bar and speed up unlatching of said latchable operating mechanism.

2. The circuit breaker of claim 1 wherein said moveable contact assembly comprises a pivotally mounted base member to which said latchable operating mechanism is coupled and a contact arm carrying said moveable contact, said blow open coupling pivotally coupling said contact arm to said base member for rotation relative to said base member in response to magnetic repulsion forces generated by the short circuit.

3. The circuit breaker of claim 2 wherein said trip bar comprises an elongated member mounted for rotation about a longitudinal axis in a first angular direction to unlatch said operating mechanism and said paddle extends laterally from said elongated member in a direction generally transverse to flow of arc gases to produce rotation of said trip bar in said first angular direction by said arc gases.

4. A circuit breaker comprising:

a plurality of poles each comprising:

separable contacts including a fixed contact and a moveable contact; and a moving contact assembly including a base member, a contact arm carrying said moveable contact and a blow open coupling rotatably mounting said contact arm to said base member;

a crossbar pivotally mounting said base members of said plurality of poles for a rotation together;

a latchable operating mechanism coupled to one of said base members for rotating, through said crossbar, said base members in said plurality of poles to simultaneously open said separable contacts in said plurality of poles when said latchable operating mechanism is unlatched; and a trip unit incorporating a trip bar extending across said plurality of poles and rotatable to unlatch said latchable operating mechanism in response to an overcurrent in any of said poles, said trip bar having a laterally extending paddle in at least one pole against which arc gases generated by a blow open in that pole bear to rotate said trip bar and speed up unlatching of the latchable operating mechanism.

5. The circuit breaker of claim 4 wherein said trip bar has a paddle extending laterally in a plurality of said poles against which arc gases generated in an associated pole bear to rotate said trip bar to speed up unlatching of the latchable operating mechanism.

6. The circuit breaker of claim 5 wherein said trip unit includes a trip mechanism for each pole, and said crossbar being positioned between said separable contacts and said trip mechanism, said crossbar having a lateral projection in at least one pole extending transversely to and deflecting said arc gases from impinging directly on said trip mechanism in said at least one pole.

7. The circuit breaker of claim 6 wherein said crossbar has lateral projections in at least two poles for deflecting arc gases in those poles from directly impinging on associated trip mechanisms.

8. A circuit breaker comprising:

a plurality of side-by-side poles each comprising:

separable contacts including a fixed contact and moveable contact; and a moveable contact assembly carrying said moveable contact;

a crossbar pivotally mounting the moveable contact assembly in each of said plurality of poles for rotation together;

a latchable operating mechanism coupled to said crossbar for rotating said crossbar to simultaneously open said separable contacts in said plurality of poles when unlatched; and a trip unit incorporating a trip bar extending across said plurality of poles and rotatable to unlatch said latchable operating mechanism in response to overcurrent in any of said poles, said crossbar being positioned between said separable contacts and said trip unit and having a lateral projection in multiple poles extending generally transversely to and deflecting arc gases generated in said multiple poles during current interruption from impinging directly upon said trip unit.

* * * * *